US005395220A

United States Patent [19]

Miura et al.

[11] Patent Number: 5,395,220

[45] Date of Patent: Mar. 7, 1995

[54] SPEED DETECTOR OF SCROLL-TYPE FLUID MACHINE

[75] Inventors: Shigeki Miura; Ryuhei Tanigaki; Takayuki Iio, all of Aichi, Japan

[73] Assignee: Mitsubishi Jukogyo Kabushiki Kaisha, Tokyo, Japan

[21] Appl. No.: 235,086

[22] Filed: Apr. 29, 1994

[30] Foreign Application Priority Data

Apr. 30, 1993 [JP] Japan ..... 5-104647

[51] Int. Cl.[6] ..... F01C 21/00

[52] U.S. Cl. ..... 418/2; 418/55.3; 464/102; 73/253

[58] Field of Search ..... 418/2, 55.3; 73/253, 73/255; 464/29, 102

[56] References Cited

U.S. PATENT DOCUMENTS 5,150,612 9/1992 Lew ..... 73/253
5,269,668 12/1993 Lew et al. ..... 73/253

FOREIGN PATENT DOCUMENTS 59-073318 4/1984 Japan .
59-115494 7/1984 Japan .
0200084 8/1989 Japan ..... 418/2

*Primary Examiner*—Richard A. Bertsch
*Assistant Examiner*—Charles G. Freay
*Attorney, Agent, or Firm*—Arnold, White & Durkee

[57] ABSTRACT

A speed detector of a scroll-type fluid machine in which a fixed scroll and an orbiting scroll, each of which includes a spiral wrap disposed on the inner surface of an end plate thereof, are engaged with each other and housed in a closed housing, and the orbiting scroll revolves while its rotation is checked by means of an Oldham's ring having the orbiting scroll disposed on the outer surface thereof, wherein the Oldham's ring is formed of a magnetic material, and an electromagnetic induction type revolution signal detecting means is installed in an opposed relationship to the Oldham's ring.

3 Claims, 3 Drawing Sheets

SPEED DETECTOR OF SCROLL-TYPE FLUID MACHINE

FIELD OF THE INVENTION AND RELATED ART STATEMENT

The present invention relates to a speed detector of a scroll-type fluid machine used as a compressor, expander, etc.

FIG. 4 is a longitudinal sectional view of the main part of a typical conventional scroll-type compressor. In this figure, a closed housing 1 contains a fixed scroll 10 and an orbiting scroll 14. The fixed scroll 10 is provided with an end plate 11 (not shown) and a spiral wrap 12 which is disposed on the inner surface of the end plate 11. The orbiting scroll 14 is provided with an end plate 15 and a spiral wrap 16 which is disposed on the inner surface of the end plate 15 and has substantially the same shape as that of the aforementioned spiral wrap 12. The orbiting scroll 14 and the fixed scroll 10 are engaged with each other at a shifted angle of 180 degrees in such a manner that they are eccentric to each other by a radius of orbital revolution as shown in the figure. This construction provides a plurality of compression chambers 19.

At one place on the outer peripheral surface of the end plate 15 of the orbiting scroll 14, an iron piece 40 is fixed as a magnetic piece for generating revolution signals. On the peripheral wall of the closed housing 1 opposed to the iron piece 40, an electromagnetic induction type speed sensor 50 is installed as a revolution signal detecting means with a predetermined gap being formed between the iron piece 40 and the speed sensor 50. The speed sensor 50 comprises a permanent magnet, a magnetic core portion, and a coil wound around the magnetic core portion. When the iron piece 40 revolves following the orbiting scroll 14, the flux of the magnetic core portion changes, so that the same frequency as the revolution frequency of the iron piece 40 and an output voltage in proportion to the revolution frequency are produced in the coil according to the principle of electromagnetic induction. Therefore, from the value of this frequency, the number of revolution of the compressor can be detected. For example, when a difference greater than a predetermined value occurs between the speed of an engine etc., which is a driving source of the compressor, and the speed detected by the speed sensor 50, and this phenomenon continues for some period of time, it can be determined that the compressor is in a locked state. In such a case, the power transmission between the engine and the compressor is cut off to prevent the cutting of belt or other accidents. Alternatively, various measures can be taken.

With the aforementioned conventional speed detector of the scroll-type fluid machine, the iron piece 40 fixed on the outer peripheral surface of the end plate of the orbiting scroll 14 as a magnetic piece for generating revolution signals increases the cost in fabricating and assembling. In addition, since the area opposed to the sensor and the volume of the iron piece 40 are relatively small, the output voltage produced in the coil of the speed sensor 50 by the revolution of the iron piece 40 varies according to fabrication tolerance, assembly tolerance, shape tolerance of the speed sensor 50 and the iron piece 40, etc., and the absolute value of the output voltage is low. For these reasons, it is impossible to accurately detect the number of revolution of the compressor. Therefore, the conventional speed detector has a disadvantage that the locked state of the compressor cannot be determined exactly due to a disturbance factor such as electrical noise.

OBJECT AND SUMMARY OF THE INVENTION

An object of the present invention is to provide a speed detector of a scroll-type fluid machine in which the output voltage produced in an electromagnetic induction type revolution signal detecting means is sufficiently high due to the reciprocating motion of an Oldham's ring, the detection accuracy of the number of revolution of a scroll-type fluid machine is enhanced, and consequently the locked state of the compressor can be determined exactly, so that appropriate measures can be taken and the manufacturing cost can be lowered.

To solve the above problems and to achieve the above object, in the scroll-type fluid machine of the present invention in which a fixed scroll and an orbiting scroll, each of which includes a spiral wrap disposed on the inner surface of an end plate thereof, are engaged with each other and housed in a closed housing, and the orbiting scroll revolves while its rotation is checked by means of an Oldham's ring having the orbiting scroll disposed on the outer surface thereof, the Oldham's ring is formed of a magnetic material, and an electromagnetic induction type revolution signal detecting means is installed in an opposed relationship to the Oldham's ring.

The above measures result in the following operation: The Oldham's ring formed of a magnetic material, which is opposed to the revolution signal detecting means, has a sufficient large opposing area and volume, so that the output voltage produced in the electromagnetic induction type revolution signal detecting means due to the reciprocating motion of the Oldham's ring is sufficiently high, by which the detection accuracy of the number of revolution of the scroll-type fluid machine is enhanced. In addition, since there is no need for installing an iron piece at the periphery of the end plate of the orbiting scroll as a magnetic piece for generating revolution signals, the manufacturing process is simplified.

DETAILED DESCRIPTION OF PREFERRED EMBODIMENTS

Figure 1:
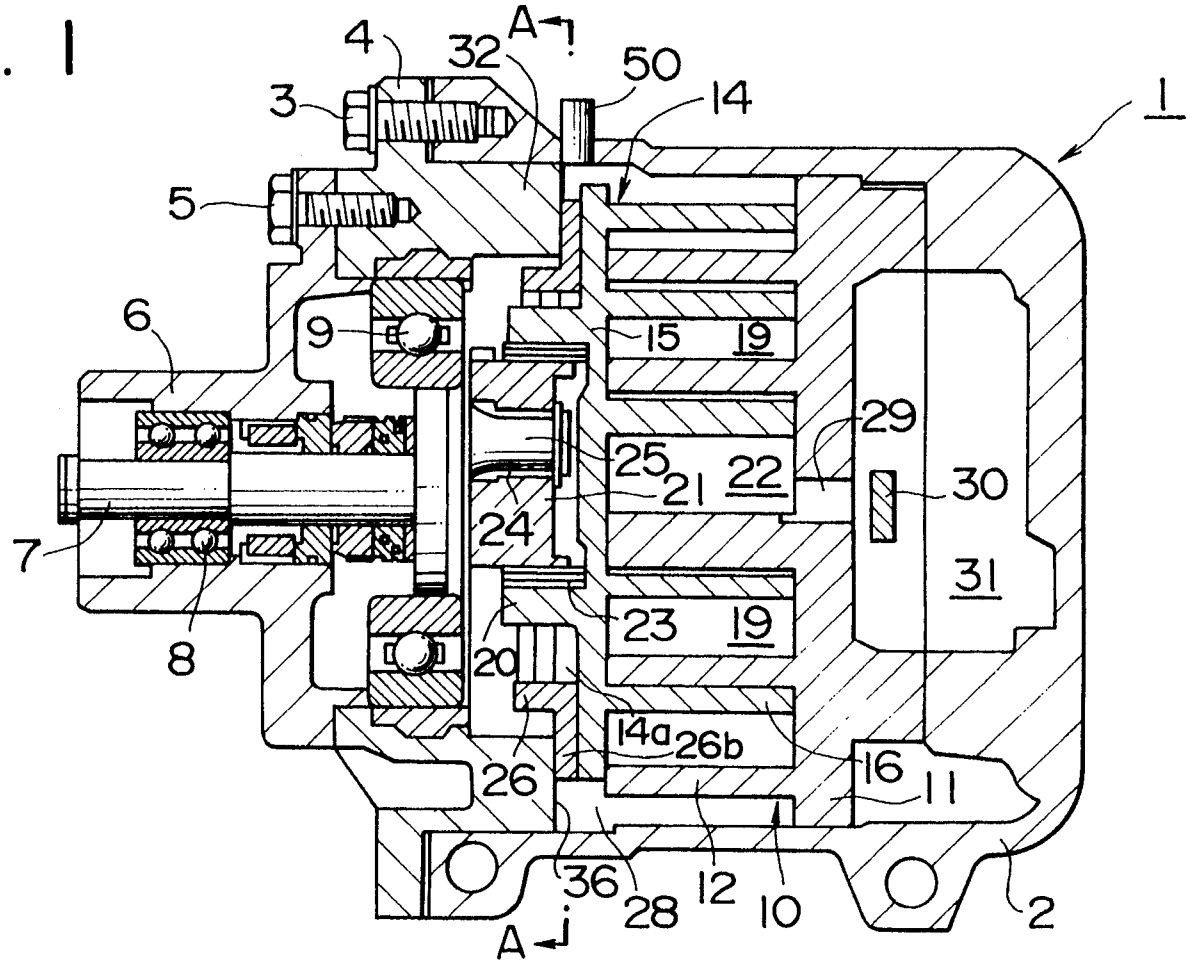
FIG. 1 is a longitudinal sectional view of the main part of a scroll-type compressor in accordance with one embodiment of the present invention.
Figure 2:
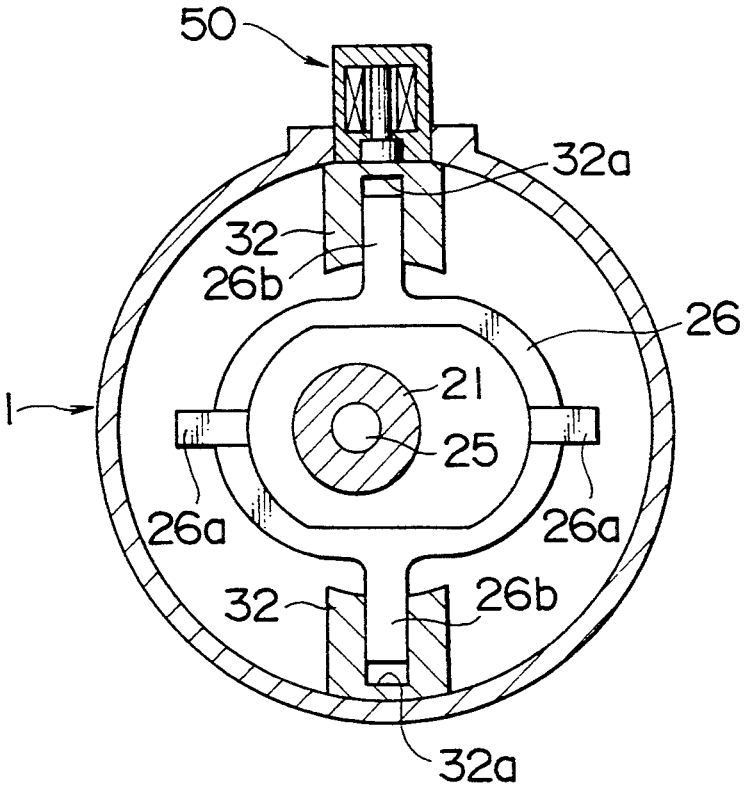
FIG. 2 is a sectional view taken along the line A—A of FIG. 1.
Figure 3:
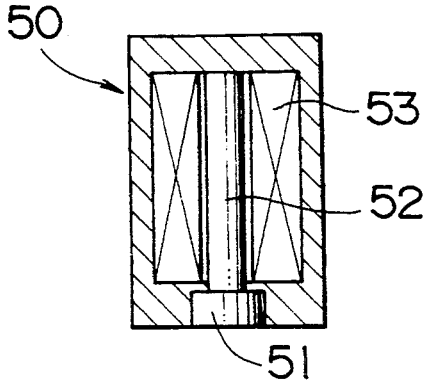
FIG. 3 is a schematic sectional view of a speed sensor.
Figure 4:
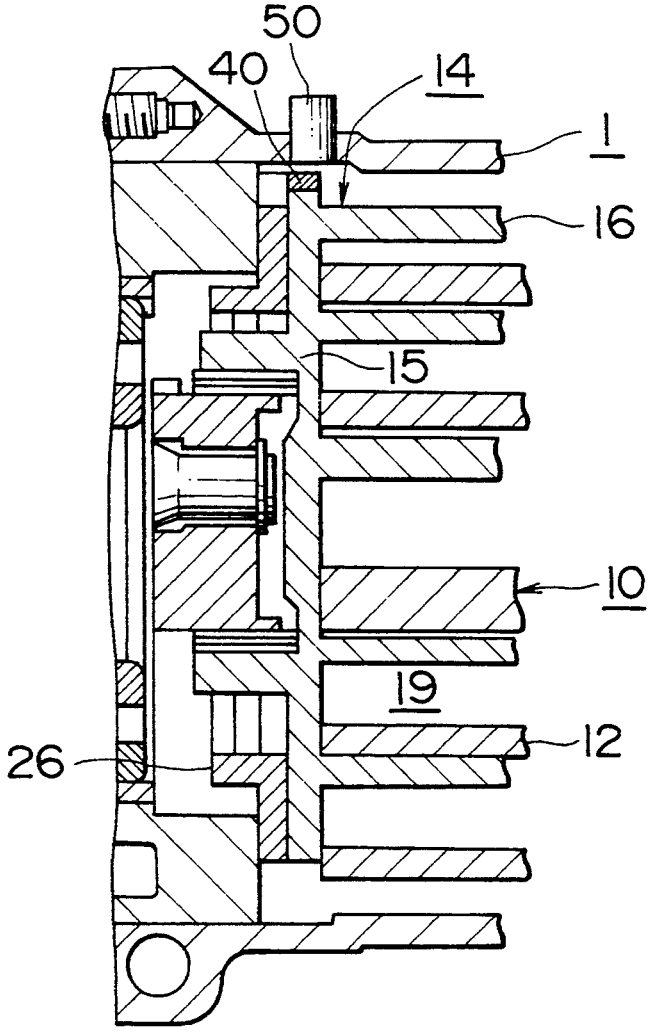
FIG. 4 PRIOR ART
FIG. 4 is a sectional view of the main part of a conventional scroll-type compressor.

FIG. 1 is a longitudinal sectional view of the main part of a scroll-type compressor in accordance with one embodiment of the present invention, FIG. 2 is a sectional view taken along the line A—A of FIG. 1, and FIG. 3 is a schematic sectional view of a speed sensor.

In FIGS. 1, 2, and 3, a closed housing 1 comprises a cup-shaped body 2, a front end plate 4 fastened to the body 2 with bolts 3, and a cylindrical member 6 fastened to the front end plate 4 with bolts 5. A rotating shaft 7 extending through the cylindrical member 6 is rotatably mounted to the housing 1 via a bearings 8 and 9. A fixed scroll 10 and an orbiting scroll 14 are disposed in the housing 1.

The fixed scroll 10 is provided with an end plate and a spiral wrap 12 which is disposed on the inner surface of the end plate 11. By bringing the outer peripheral surface of the end plate 11 into contact with the inner peripheral surface of the cup-shaped body 2, the interior of the housing 1 is partitioned, so that a discharge cavity 31 is formed on the outside of the end plate 11, and a suction chamber 28 is formed on the inside of the end plate 11. In a discharge port 29 formed at the center of the end plate 11, a discharge valve 30 is installed to open/close the discharge port 29.

The orbiting scroll 14 is provided with an end plate 15 and a spiral wrap 16 which is disposed on the inner surface of the end plate 15 and has substantially the same shape as that of the aforementioned spiral wrap 12. The orbiting scroll 14 and the fixed scroll 10 are engaged with each other at a shifted angle of 180 degrees in such a manner that they are eccentric to each other by a radius of revolution as shown in the figure. This construction provides a plurality of compression chambers 19.

In a cylindrical boss 20 formed at the center of the outer surface of the end plate 15, a drive bush 21 is rotatably inserted via a rotating bearing 23. This drive bush 21 has a slide groove 24, into which is slidably fitted an eccentric drive pin 25 protruding from the inner end of the rotating shaft 7 in an off-centered manner.

Between the periphery of the outer surface of the end plate 15 and the inner surface of a support 32 formed at the inner periphery of the front end plate 4, an Oldham's ring 26 is disposed as a mechanism for checking the rotation of a thrust bearing 36 and the orbiting scroll 14.

The Oldham's ring, as shown in FIG. 2, has a doughnut shape, and is provided with a pair of protrusion-shaped first keys **26*a* and a pair of protrusion-shaped second keys 26*b* protruding at right angles to the first keys 26*a*. The first keys 26*a* are slidably fitted into grooves 14*a* formed on the outer surface of the end plate 15, whereas the second keys 26*b* are slidably fitted into grooves 32*a* formed on the upper surface of the support 32. Therefore, the Oldham's ring 26 reciprocates only along the grooves 32*a* with respect to the support 32, and the orbiting scroll 14 reciprocates only along the grooves 14*a* with respect to the Oldham's ring. Thus, the rotation of the orbiting scroll 14** is checked.

When the rotating shaft 7 is rotated by a not illustrated engine, etc. via, for example, a belt, the orbiting scroll 14 is driven via a revolution drive mechanism consisting of the eccentric drive pin 25, the drive bush 21, the boss 20, etc., and revolves on the circular locus with a revolution radius, which is an offset between the rotating shaft 7 and the eccentric drive pin 25 while the rotation of the orbiting scroll 14 is checked by the Oldham's ring. Thus, the gas fed from a not illustrated suction port to the compression chamber 19 via the suction chamber 28 moves toward the center of the spiral as the volume of the compression chamber 19 is decreased, and reaches the central chamber 22 while being compressed. Then, the gas leaves the central chamber 22 by passing through the discharge port 29, fed into the discharge cavity 31 by pushing to open the discharge valve, and flows out of the closed housing 1.

The Oldham's ring 26 for checking the rotation of the orbiting scroll 14 is formed of a magnetic material such as ferrous sintered metal. On the peripheral wall of the closed housing 1 opposed to the outer periphery of the position where the Oldham's ring 26 is installed, an electromagnetic induction type speed sensor 50 is disposed as a revolution signal detecting means in such a manner as to be opposed to the second keys **26*b*** with a predetermined gap.

The speed sensor 50 comprises a permanent magnet 51, a magnetic core portion 52, and a coil 53 wound around the magnetic core portion 52. When the orbiting scroll 14 revolves, the protrusions, that is, the second keys **26*b* turn due to this revolving motion, so that the flux of the magnetic core portion 52 of the speed sensor 50 changes, by which the same frequency as the revolution frequency of the orbiting scroll 14 and an output voltage in proportion to the revolution frequency are produced in the coil 53 according to the principle of electromagnetic induction. Therefore, from the value of this frequency, the number of revolution of the rotating shaft 7**, that is, the number of revolution of the compressor can be detected.

According to the embodiment constituted as described above, the following operating effects are produced: Since the Oldham's ring reciprocates with the same period as that of the revolution of the orbiting scroll 14, the flux of the magnetic core portion 52 of the speed sensor 50 changes due to the reciprocating motion of the Oldham's ring formed of a magnetic material, so that the same frequency as the frequency of reciprocating motion of the Oldham's ring 26 and an output voltage in proportion to the frequency are produced in the coil 53 according to the principle of electromagnetic induction. Therefore, from the value of this frequency, the number of revolution of the compressor can be detected.

Since the Oldham's ring 26 opposed to the speed sensor 50 has a sufficiently large opposing area and volume, the output voltage of the speed sensor 50 produced by the reciprocating motion of the Oldham's ring is considerably high compared with the conventional iron piece 40. Therefore, the frequency, that is, the number of revolution of the compressor can be detected accurately.

For example, when a difference greater than a predetermined value occurs between the speed of an engine etc., which is a driving source of the compressor, and the speed detected by the speed sensor 50, and this phenomenon continues for some period of time, it can be determined that the compressor is in a locked state. In such a case, the power transmission between the engine and the compressor is cut off to prevent the cutting of belt or other accidents. Alternatively, various measures can be taken.

The present invention is not limited to the above-described embodiment, and it is obvious that various modifications can be made in the invention without departing from the spirit and scope thereof.

According to the present invention, an Oldham's ring formed of a magnetic material is used as a magnetic piece for a revolution signal generating means, so that the opposing area and volume of the magnetic piece increase. Therefore, the output voltage produced in the electromagnetic induction type revolution signal detecting means due to the reciprocating motion of the Oldham's ring is sufficiently high, so that the detection accuracy of the number of revolution of a scroll-type fluid machine is enhanced. As a result, the locked state of the compressor can be determined exactly, so that appropriate measures can be taken. In addition, there is no need for installing an iron piece as a revolution signal generating means. This provides a speed detector of a scroll-type fluid machine in which manufacturing cost can be lowered.

We claim:

1. A speed detector of a scroll-type fluid machine in which a fixed scroll and an orbiting scroll, each of which includes a spiral wrap disposed on the inner surface of an end plate thereof, are engaged with each other and housed in a closed housing, and said orbiting scroll revolves while its rotation is checked by means of an Oldham's ring having said orbiting scroll disposed on the outer surface thereof, wherein said Oldham's ring is formed of a magnetic material, and an electromagnetic induction type revolution signal detecting means is installed in an opposed relationship to said Oldham's ring.

2. A speed detector of a scroll-type fluid machine according to claim 1 wherein said revolution signal detecting means comprises a permanent magnet, a magnetic core portion, and a coil wound around said magnetic core portion, the frequency of an A.C. voltage produced in said coil by the reciprocating motion of said Oldham's ring caused by the revolution of said orbiting scroll being detected, and the number of revolutions of said orbiting scroll being detected from said detected frequency.

3. A speed detector of a scroll-type fluid machine according to claim 1 wherein said Oldham's ring is formed of a ferrous sintered metal.

* * * * *